US005702240A

United States Patent [19]

O'Neal et al.

[11] Patent Number: 5,702,240

[45] Date of Patent: Dec. 30, 1997

[54] ROTARY POSITIVE DISPLACEMENT BLOWER HAVING A DIVERGING OUTLET PART

[75] Inventors: Alan D. O'Neal, Willard; Michael D. Stone, Rogersville; Carl R. Coles, Springfield, all of Mo.

[73] Assignee: Tuthill Corporation, Chicago, Ill.

[21] Appl. No.: 437,147

[22] Filed: May 5, 1995

[51] Int. Cl.[6] ..... F04C 18/18

[52] U.S. Cl. ..... 418/9; 418/15; 418/180; 418/206.4

[58] Field of Search ..... 418/9, 15, 180, 418/206.1, 206.4

[56] References Cited

U.S. PATENT DOCUMENTS

| | | | |
|---|---|---|---|
| 30,157 | 9/1860 | Roots . | |
| 44,892 | 11/1864 | Roots . | |
| 56,614 | 7/1866 | Roots et al. . | |
| 58,745 | 10/1866 | Roots . | |
| 73,654 | 1/1868 | Roots et al. . | |
| 81,009 | 8/1868 | Roots et al. . | |
| 81,010 | 8/1868 | Roots et al. . | |
| 704,224 | 7/1902 | Wainwright | 418/206.1 |
| 2,108,786 | 2/1938 | Bigelow et al. . | |
| 2,161,695 | 6/1939 | Bigelow et al. . | |
| 2,489,887 | 11/1949 | Houghton | 418/180 |
| 3,089,638 | 5/1963 | Rose . | |
| 3,121,529 | 2/1964 | Hubrich | 418/180 |
| 3,746,482 | 7/1973 | Luthi | 418/206.4 |
| 4,215,977 | 8/1980 | Weatherston | 418/180 |
| 4,609,335 | 9/1986 | Uthoff, Jr. | 418/206.4 |
| 4,758,140 | 7/1988 | Durach et al. | 418/206.1 |
| 4,781,541 | 11/1988 | Sohler et al. | 418/206.1 |
| 5,090,879 | 2/1992 | Weinbrecht | 418/206.4 |

FOREIGN PATENT DOCUMENTS

| | | | |
|---|---|---|---|
| Ad.62565 | 1/1995 | France | 418/206 |
| 64-32085 | 2/1989 | Japan | 418/15 |
| 540497 | 10/1941 | United Kingdom | 418/206 |
| 1 350 636 | 4/1974 | United Kingdom . | |
| 2 178 458 A | 2/1987 | United Kingdom . | |

OTHER PUBLICATIONS

Dresser Industries, Inc. brochure "Your Single Source for Rotating Equipment" 1990.

*Primary Examiner*—John J. Vrablik

*Attorney, Agent, or Firm*—Lee, Mann, Smith, McWilliams, Sweeney & Ohlson

[57] ABSTRACT

A rotary positive displacement blower for producing a flow of fluid. The blower includes a housing having a rotor chamber, an inlet port and an outlet port. The outlet port has a first end and a second end and a first edge and a second edge which extend from the first end towards the second end while becoming increasingly spaced apart from one another. A first rotor and a second rotor are located in the rotor chamber. Each rotor includes a plurality of lobes and are each rotatable about a respective axis. Each rotor includes a plurality of pockets adapted to rotate into fluid communication with the inlet port to receive fluid and to rotate into fluid communication with the outlet port to deliver fluid as the rotors rotate. Fluid passages located in the housing extend between the outlet port and the rotor chamber to provide a flow of high pressure fluid from the outlet port to the pockets of the rotors to pre-pressurize the fluid contained therein before each pocket rotates into fluid communication with the outlet port thereby reducing pressure pulsations and resulting noise and vibration.

13 Claims, 5 Drawing Sheets

ROTARY POSITIVE DISPLACEMENT BLOWER HAVING A DIVERGING OUTLET PART

BACKGROUND OF THE INVENTION

The present invention is directed to a rotary positive displacement blower and in particular to a rotary positive displacement blower which reduces discharge pulses that produce high levels of noise and vibration.

Existing rotary positive displacement blowers generally include two rotors which rotate in opposite directions within a housing. As each rotor passes the inlet opening of the housing at the low pressure side of the blower, the rotor traps a defined volume of low pressure fluid in a pocket and carries the fluid around to the discharge opening of the housing where the fluid is expelled to the high pressure side of the blower. As the fluid which is trapped in the pocket comes into communication with the high pressure fluid at the discharge side of the blower, the high pressure fluid flows back through the discharge opening into the exposed pocket of trapped low pressure fluid due to the pressure differential between the trapped fluid and the compressed fluid. In conventional blower designs the compression of the trapped fluid within the pocket occurs substantially instantaneously, resulting in high pressure pulsations which produce high levels of noise and vibration.

There are two parameters which affect the magnitude of the undesirable pressure pulsations. The first parameter is the magnitude of the pressure rise that occurs when the low pressure fluid in a pocket comes into communication with the high pressure fluid through the outlet port. The second parameter is the rate at which the fluid in the pocket is pressurized by the backflow of the high pressure fluid through the outlet port into the pocket of fluid. In conventional blower designs, the magnitude of the pressure rise which the fluid in the pockets undergoes during backflow is equal to the difference in pressure between the pressure of the fluid at the inlet port of the blower and the pressure of the fluid at the outlet port of the blower, which is at a higher pressure than the fluid of the inlet port. The rate at which the pockets of fluid are pressurized in conventional blower designs is nearly instantaneous, occurring when each pocket of fluid initially opens to the outlet port in the housing. The present invention reduces these parameters providing a blower which produces reduced levels of noise and vibration.

SUMMARY OF THE INVENTION

A rotary positive displacement blower is provided for producing a flow of fluid. The blower includes a housing having a rotor chamber, an inlet port and an outlet port. A first rotor is located in the rotor chamber. The first rotor includes a plurality of lobes and is rotatable about a first axis. The first rotor forms a plurality of pockets with each pocket being located between adjacent lobes of the first rotor. Each pocket is adapted to rotate into fluid communication with the inlet port, to receive fluid at a first pressure through the inlet port, and to rotate into fluid communication with the outlet port, to deliver fluid from the pocket through the outlet port at a second pressure which is higher than the first pressure, as the first rotor rotates. A second rotor is also located in the rotor chamber. The second rotor includes a plurality of lobes and is rotatable about a second axis. The second rotor forms a plurality of pockets with each pocket being located between adjacent lobes of the second rotor. Each pocket of the second rotor is adapted to rotate into fluid communication with the inlet port, to receive fluid through the inlet port at the first pressure, and to rotate into fluid communication with the outlet port to deliver fluid in the pocket through the outlet port at the second pressure as the second rotor rotates.

A first fluid passage is located in the housing and extends between the outlet port and the rotor chamber. The first fluid passage includes a first injector port in fluid communication with the rotor chamber. The first fluid passage provides a flow of high pressure fluid from the outlet port into each pocket of the first rotor through the first injector port as the first rotor rotates. This increases the pressure of the fluid in each pocket of the first rotor before each pocket rotates into fluid communication with the outlet port. The pressure differential between the pressure of the fluid in each pocket after being pre-pressurized by the first fluid passage and the second pressure of the previously discharged high pressure fluid is thereby decreased when the pocket opens to the outlet port. A second fluid passage is also located in the housing which extends between the outlet port and the rotor chamber. The second fluid passage includes a second injector port in fluid communication with the rotor chamber. The second fluid passage provides fluid communication between the outlet port and the rotor chamber and provides a flow of high pressure fluid into each pocket of the second rotor through the second injector port as the second rotor rotates thereby increasing the pressure of the fluid contained in each pocket of the second rotor before each pocket rotates into fluid communication with the outlet port.

The outlet port includes an opening having a width which varies in size from a relatively small width at each end of the outlet port where the pockets of the first and second rotors initially come into fluid communication with the outlet port to increasingly wider widths. The varying widths of the outlet port control the rate at which the high pressure fluid flows through the outlet port into a pocket and thereby the rate of pressurization of the fluid within the pocket.

DESCRIPTION OF THE PREFERRED EMBODIMENT

Figure 1:
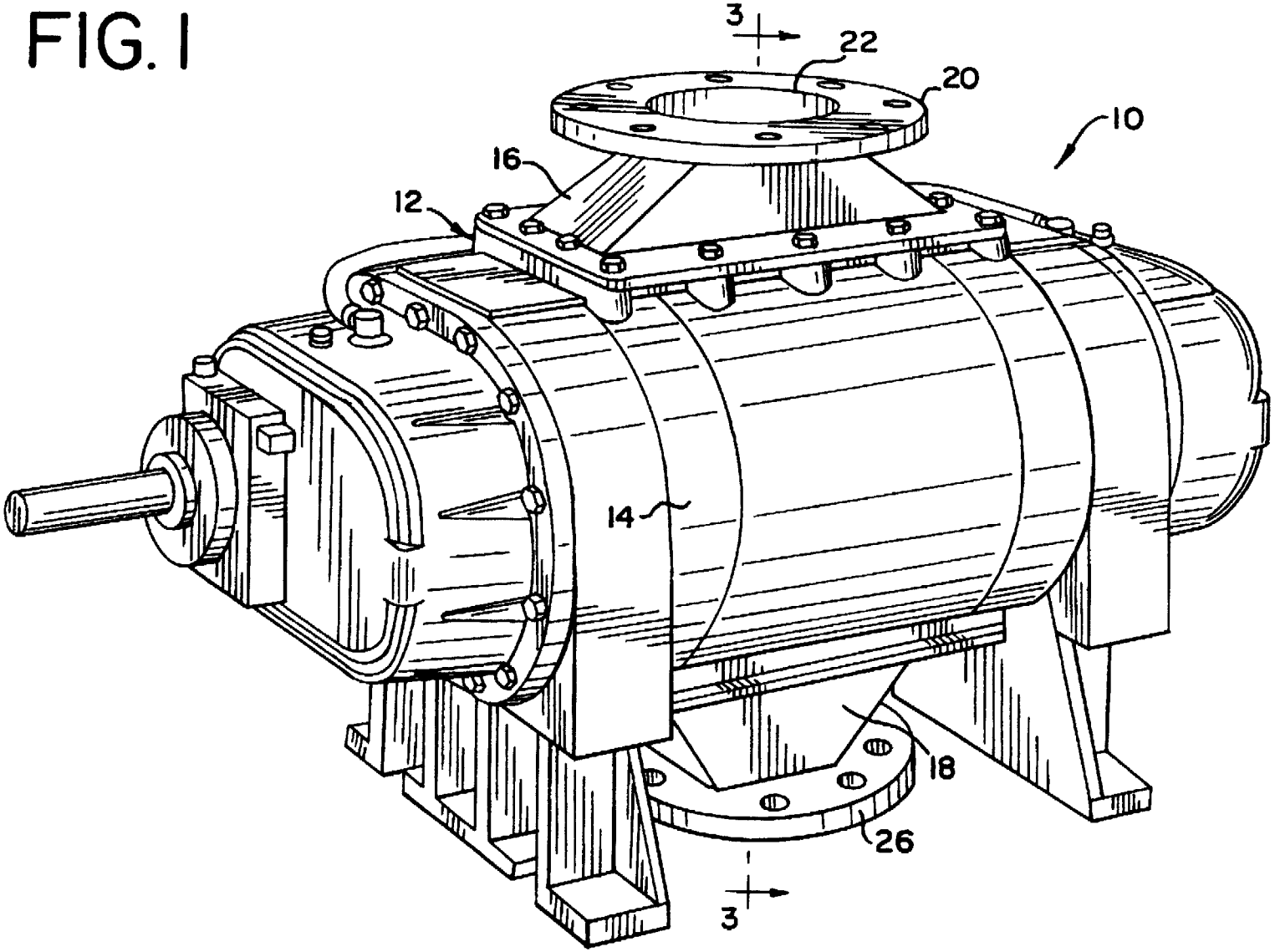
FIG. 1 is a perspective view of the rotary positive displacement blower of the present invention.
Figure 2:
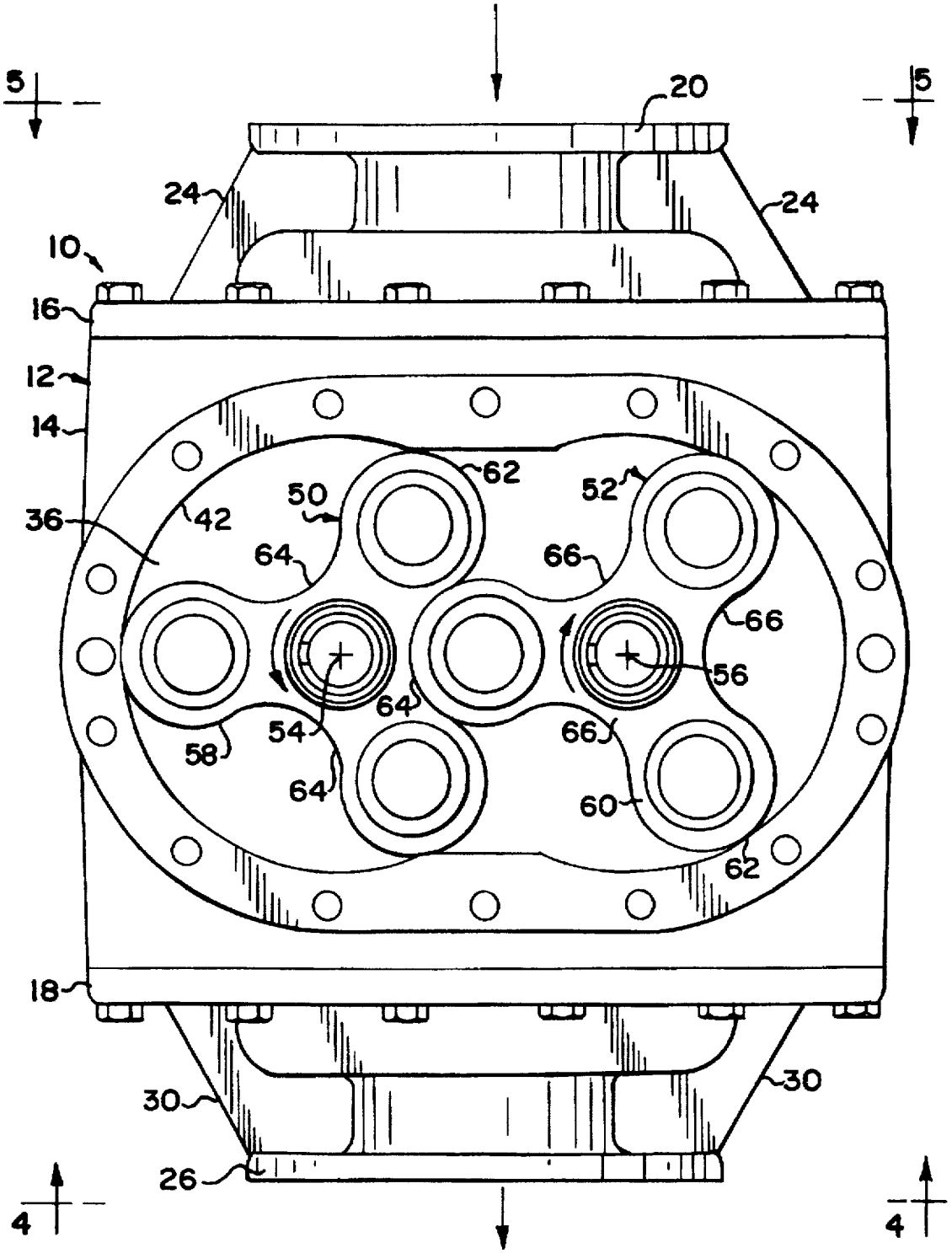
FIG. 2 is a side elevational view of the blower with a portion of the housing removed exposing the rotor chamber.

The rotary positive displacement blower 10 of the present invention includes a housing 12 as shown in FIGS. 1 and 2. The housing 12 comprises a center rotor housing 14, an intake housing 16 and a discharge housing 18. The intake housing 16 and the discharge housing 18 are removably secured and sealed to the rotor housing 14 by fasteners. The intake housing 16 includes a flange 20 having an intake port 22. The flange 20 is adapted to connect the blower 10 to piping or other means connected to a source of fluid, such as a gas, at a first pressure (low pressure fluid). The intake housing 16 also includes a plurality of ribs 24 which reinforce the intake housing 16 and the flange 20 to prevent vibration thereof. The discharge housing 18 includes a flange 26 having a discharge port 28 adapted to be connected to piping or other mechanical equipment which receives fluid discharged from the blower at a second pressure that is higher than the first pressure (high pressure fluid) due to accumulation of the fluid at the discharge side of the blower 10. A plurality of ribs 30 reinforce and stiffen the discharge housing 18 and flange 26.

Figure 3:
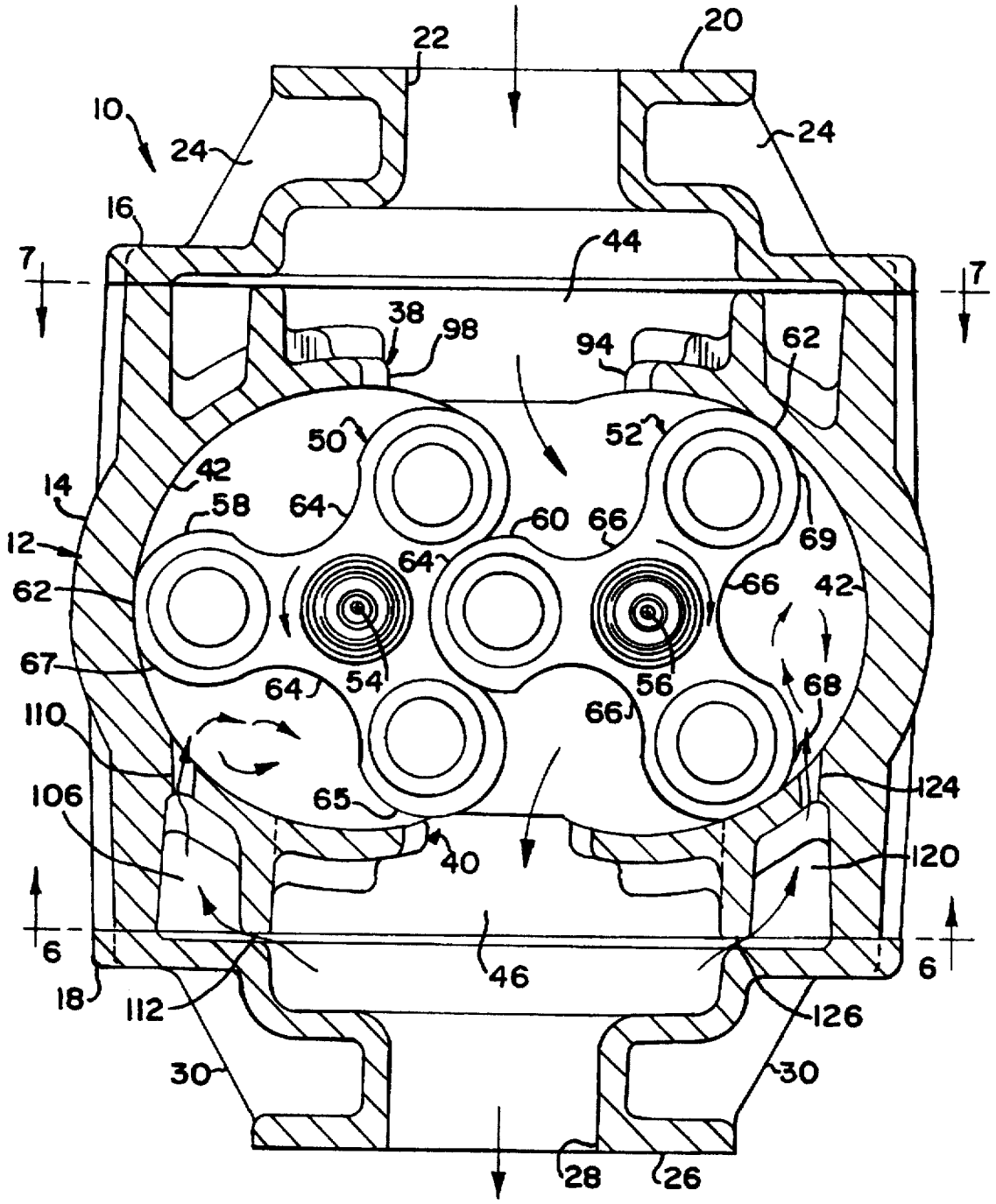
FIG. 3 is a cross-sectional view of the blower taken along lines 3—3 of FIG. 1.
Figure 4:
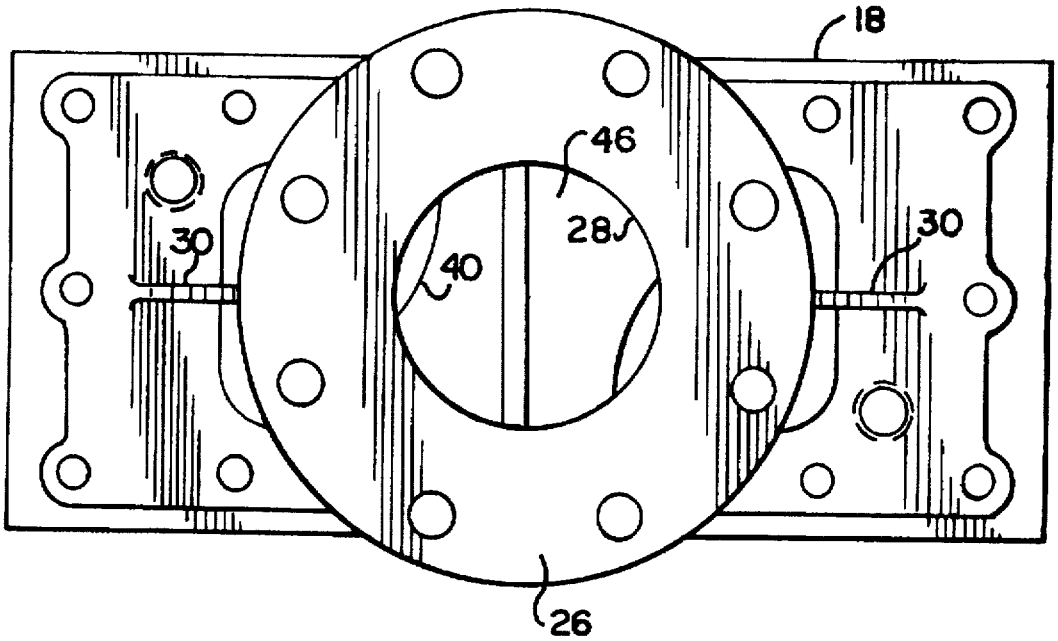
FIG. 4 is a bottom view of the blower taken along lines 4—4 of FIG. 2.
Figure 5:
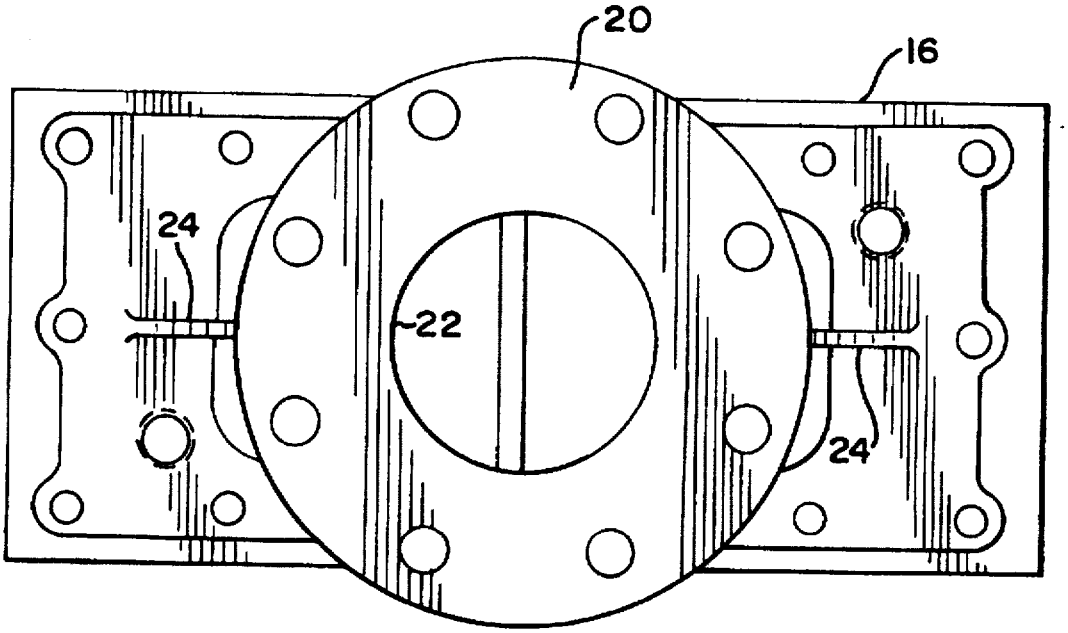
FIG. 5 is a top plan view of the blower taken along lines 5—5 of FIG. 2.

As best shown in FIGS. 2 and 3, the housing 12 includes a rotor chamber 36 of generally elliptical shape located in the rotor housing 14. The rotor chamber 36 includes an inlet port 38, an outlet port 40 and an internal peripheral wall 42. The housing 12 also includes an intake chamber 44 which provides fluid communication between the intake port 22 of the flange 20 and the inlet port 38 of the rotor chamber 36. The intake chamber 44 receives and contains low pressure fluid at the first pressure. The housing 12 also includes a discharge chamber 46 which provides fluid communication between the outlet port 40 of the rotor chamber 36 and the discharge port 28 of the flange 26. The discharge chamber 46 receives and contains high pressure fluid at the second pressure, which is higher than the first pressure of the low pressure fluid in the intake chamber 44, for discharge through the discharge port 28.

The blower 10 also includes a first rotor 50 and a second rotor 52. The rotor 50 is rotatable about an axis 54 and the rotor 52 is rotatable about an axis 56 which is parallel to and spaced apart from the axis 54. As best shown in FIG. 3, the rotors 50 and 52 rotate in opposite directions relative to one another. The rotor 50 is shown as rotating in a counter-clockwise direction and the rotor 52 is shown as rotating in a clockwise direction. The rotor 50 includes three lobes 58 of generally equal length which are uniformly spaced about the axis 54. The rotor 52 also includes three lobes 60 which are of the same length as the lobes 58 and which are uniformly spaced about the axis 56. Each lobe 58 and 60 includes a tip 62 which is located closely adjacent to the peripheral wall 42 of the rotor chamber 36 during a portion of its rotation. While the rotors 50 and 52 each preferably include three lobes, each rotor 50 and 52 may alternatively include only two lobes or more than three lobes if desired. The rotor 50 includes three generally concave pockets 64, with each pocket 64 being respectively located between two adjacent lobes 58. Each pocket 64 includes a leading edge 65 and a trailing edge 67 which extend the width of the pocket 64. The rotor 52 also includes three generally concave pockets 66, with each pocket 66 being respectively located between two adjacent lobes 60. Each pocket 66 includes a leading edge 68 and a trailing edge 69 which extend the width of the pocket 66. As best shown in FIG. 3, the rotors 50 and 52 rotate in intermeshing engagement with one another such that a lobe of one rotor fits closely within a pocket of the other rotor as the rotors rotate.

As the rotor 50 rotates, each of the pockets 64 sequentially rotate into fluid communication with the inlet port 38 of the rotor chamber 36 to receive low pressure fluid at a first pressure from the intake chamber 44 through the inlet port 38. Thereafter, each pocket 64 sequentially rotates along the peripheral wall 42 of the rotor chamber 36 such that the fluid within each pocket 64 is trapped within a chamber formed between the pocket 64 of the rotor 50 and the wall 42 of the rotor chamber 36. Each pocket 64 sequentially rotates into fluid communication with the outlet port 40 of the rotor chamber 36 to discharge fluid contained within the pocket 64 into the discharge chamber 46 through the outlet port 40. The rotor 52 operates in the same manner rotating the pockets 66 in the opposite direction into sequential fluid communication with the inlet port 38 to receive low pressure fluid and then the outlet port 40 to discharge fluid into the discharge chamber 46.

Figure 6:
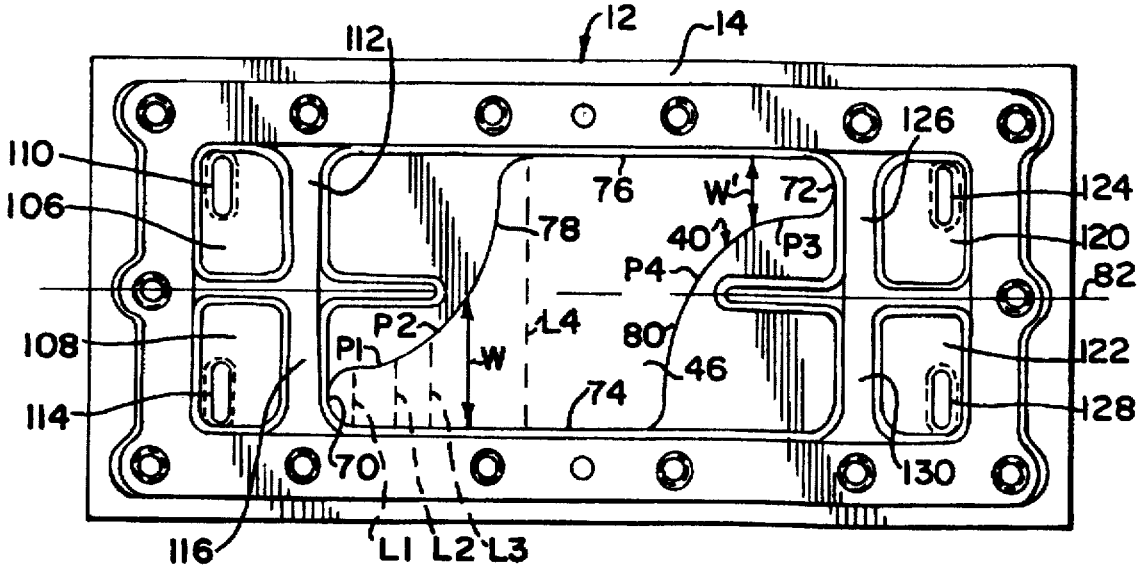
FIG. 6 is a bottom view of the rotor housing taken along lines 6—6 of FIG. 3.

As best shown in FIG. 6, the outlet port 40 of the rotor chamber 36 is irregularly shaped. The outlet port 40 extends generally transversely to the axes 54 and 56 of the rotors 50 and 52 between a first end 70 and a second end 72. The outlet port 40 includes an edge 74 which extends from the first end 70 in a plane which is generally perpendicular to the axes 54 and 56 of the rotors 50 and 52 and an edge 76 which is spaced apart from the edge 74 and which extends from the second end 72 in a plane which is generally parallel to the plane of the edge 74 and perpendicular to the axes 54 and 56. The outlet port 40 also includes a generally convexly curved edge 78 which extends from the first end 70 to the edge 76 and a generally convexly curved edge 80 which extends from the second end 72 to the edge 74. The edges 74 and 78 diverge from one another as the edges 74 and 78 become spaced increasingly farther apart from one another as the edges 74 and 78 extend away from the first end 70 of the outlet port 40 toward the second end 72. The edges 76 and 80 also diverge from one another as the edges 76 and 80 become spaced increasingly farther apart from one another as the edges 76 and 80 extend away from the second end 72 of the outlet port 40 toward the first end 70. The edges 78 and 80 are preferably formed in the shape of a segment of an ellipse, but may also be formed in other shapes as desired and may be generally linear. The irregular shape of the outlet port 40 provides an opening having a first variable width W dimension, measured in a direction which is generally parallel to the axes 54 and 56, between the edges 74 and 78 of the outlet port 40, and a length dimension which extends in a direction generally perpendicular to its width. As the outlet port 40 extends in the length direction from a first point P1 to a second point P2 on the edge 78, the width of the outlet port 40 between the edges 74 and 78 increases in size. The width of the opening of the outlet port 40 is initially relatively small at the first end 70 relative to the width of the pockets 64 and initially increases in size at a relatively small rate of change as the edge 78 initially extends from the first end 70 towards the edge 76. However, the width of the opening of the outlet port 40 subsequently increases in size at a faster rate until the full width of the outlet port 40 is reached between the edges 74 and 76, which is approximately equal to the width of the pockets 64 and 66. The outlet port 40 also provides an opening having a second variable width W' between the edges 76 and 80 of the outlet port 40 which increases in size in a similar manner as the edges 76 and 80 extend from the second end 72. As the outlet port 40 extends in the length direction from a third point P3 to a fourth point P4 on the edge 80, the width of the outlet port 40 between the edges 76 and 80 increases in size. The ends 70 and 72 of the outlet port 40 are located on opposite sides of a center line 82 of the blower 10 which is transverse to the axes 54 and 56 of the rotors 50 and 52.

Figure 7:
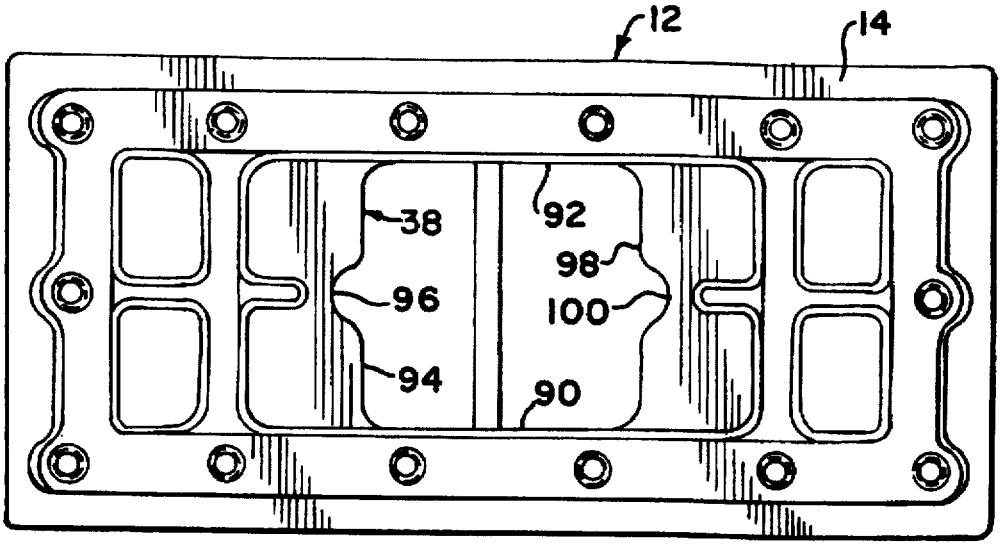
FIG. 7 is a top plan view of the rotor housing taken along lines 7—7 of FIG. 3.

As best shown in FIG. 7, the inlet port 38 of the rotor chamber 36 is substantially rectangular. The inlet port 38 includes a side edge 90 and a spaced apart side edge 92, each of which extend in a plane generally perpendicular to the axes 54 and 56. An edge 94 having a generally semi-circular notch 96 extends between the side edges 90 and 92. An edge 98 having a generally semi-circular notch 100 extends between the side edges 90 and 92 and is spaced apart from the edge 94.

As best shown in FIGS. 3 and 6, the housing 12 includes a backflow chamber 106 and a backflow chamber 108. An injector port 110 is located in the housing 12 and extends between the backflow chamber 106 and the rotor chamber 36 providing fluid communication therebetween. A backflow port 112 is located in the housing 12 and extends between the discharge chamber 46 and the backflow chamber 106 providing fluid communication therebetween. A first fluid passage is thereby formed in the housing 12 which extends from the outlet port 40 and discharge chamber 46, through the backflow chamber 106, and through the injector port 110 into the rotor chamber 36.

The housing 12 also includes an injector port 114 which extends between the backflow chamber 108 and the rotor chamber 36 to provide fluid communication therebetween. The housing 12 also includes a backflow port 116 which extends between the discharge chamber 46 and the backflow chamber 108 to provide fluid communication therebetween. The housing 12 thereby includes a second fluid passage which provides fluid communication from the outlet port 40 and discharge chamber 46, through the backflow chamber 108, and through the injector port 114 into the rotor chamber 36.

The housing 12 also includes a backflow chamber 120 and a backflow chamber 122. The housing 12 includes an injector port 124 which extends between the backflow chamber 120 and the rotor chamber 36 providing fluid communication therebetween. The housing 12 also includes a backflow port 126 which extends between the discharge chamber 46 and the backflow chamber 120 to provide fluid communication therebetween. A third fluid flow passage is thereby provided in the housing 12 which provides fluid communication from the outlet port 40 and discharge chamber 46, through the backflow chamber 120, and through the injector port 124 into the rotor chamber 36.

The housing 12 also includes an injector port 128 which extends between the backflow chamber 122 and the rotor chamber 36 to provide fluid communication therebetween. The housing 12 also includes a backflow port 130 which extends between the discharge chamber 46 and the backflow chamber 122 to provide fluid communication therebetween. A fourth fluid passage is thereby provided in the housing 12 which provides fluid communication from the outlet port 40 and discharge chamber 46, through the backflow chamber 122, and through the injector port 128 into the rotor chamber 36.

The injector ports 110, 114, 124, and 128 are formed in the shape of a slot which is elongated in a direction generally parallel to the axes 54 and 56. The injector ports may be formed in various other shapes as desired. The area of the opening provided by each injector port 110, 114, 124 and 128 is preferably approximately equal to the area of the opening provided by the corresponding backflow port 112, 116, 126 or 130. The injector ports 110 and 114 are both located in the peripheral wall 42 of the rotor chamber 36 between approximately 125° and 135° from the edge 98 of the inlet port 38 as measured in a counter clockwise direction about the rotational axis 54, and preferably at approximately 130°. The injector ports 124 and 128 are similarly preferably located in the peripheral wall 42 of the rotor chamber 36 between approximately 125° and 135° from the edge 94 of the inlet port 38 as measured in a clockwise direction about the rotational axis 56, and preferably at approximately 130°.

In operation, fluid at a first pressure (low-pressure fluid) flows through the intake port 22 of the flange 20 into the intake chamber 44. As the rotor 50 rotates, the pockets 64 sequentially come into fluid communication with the inlet port 38 of the rotor chamber 36 and the intake chamber 44. Fluid from the intake chamber 44 enters the pocket 64 of the rotor 50 which is open to the inlet port 38. As the rotor 50 continues to rotate, the fluid within the pocket 64 becomes trapped within the pocket 64 between the rotor 50 and the peripheral wall 42 of the rotor chamber 36. The fluid trapped within the pocket 64 is initially at the first pressure. As the rotor 50 continues to rotate, the pocket 64 rotates into fluid communication with the injector ports 110 and 114.

Fluid at a second pressure which is higher than the first pressure (high pressure fluid) is located within the discharge chamber 46. The higher pressure fluid within the discharge chamber 46 flows through the backflow ports 112 and 116 into the backflow chambers 106 and 108. When a pocket 64 rotates into fluid communication with the injector ports 110 and 114, the high pressure fluid within the backflow chambers 106 and 108 flows through the injector ports 110 and 114 into the pocket 64 thereby increasing the pressure of the fluid within the pocket 64 above the first pressure. The fluid in the pocket 64 thereby is pre-pressurized before rotating into fluid communication with the outlet port 40. As the rotor 50 and the pocket 64 constantly rotate during this process, the pocket 64 is in fluid communication with the injector ports 110 and 114 for a limited period of time and therefore only a limited volume of the high pressure fluid within the backflow chambers 106 and 108 flows into the pocket 64 before the pocket 64 rotates out of fluid communication with the injector ports 110 and 114. Therefore, after a pocket 64 has been in fluid communication with the injector ports 110 and 114, the pressure of the now pre-pressurized fluid within the pocket 64 is greater than the first pressure of the fluid within the intake chamber 44, but is usually still somewhat lower than the second pressure of the fluid within the discharge chamber 46.

As the rotor 50 continues to rotate, the pocket 64 rotates into fluid communication with the outlet port 40. As the fluid within the discharge chamber 46 is generally still somewhat higher than that of the pre-pressurized fluid within the pocket 64, fluid flows from the discharge chamber 46 through the outlet port 40 into the pocket 64 until the fluid in the pocket 64 reaches a pressure equal to the second pressure of the fluid within the discharge chamber 46. As the rotor 50 continues to rotate, a lobe 60 of the rotor 52 rotates into the pocket 64 to force fluid therein from the pocket 64 into the discharge chamber 46 through the outlet port 40. Fluid within the discharge chamber 46 flows through the discharge port 28 of the flange 26 for use, or through the backflow ports 112, 116, 126 and 130 into the backflow chambers 106, 108, 120 and 122 for use in pre-pressurizing the pockets 64 and 66 of the rotors 50 and 52. As the rotor 50 continues to rotate, the pocket 64 will rotate back into fluid communication with the inlet port 38 wherein the process is repeated sequentially for each pocket 64 of the rotor 50.

The same process is also followed by each of the pockets 66 of the rotor 52, which rotate in the opposite direction, except that the fluid within the pockets 66 is pre-pressurized by a flow of fluid from the discharge chamber 46 through the backflow chambers 120 and 122 and through the injector ports 124 and 128 into the pockets 66. The pre-pressurization of the fluid within the pockets 64 and 66 of the rotors 50 and 52, before the pockets rotate into fluid communication with the outlet port 40 of the discharge chamber 46, decreases the magnitude of the pressure differential between the fluid in the pockets 64 and 66 and the fluid in the discharge chamber 46, thereby reducing the undesired pressure pulsations which occur when fluid from the discharge chamber 46 flows in to the pockets 64 and 66 through the outlet port 40.

In addition, as each pocket 64 of the rotor 50 rotates into fluid communication with the outlet port 40, the leading edge 65 of each pocket 64 initially opens to the outlet port 40 at the first end 70 of the outlet port 40. As the leading edge 65 of the pocket 64 rotates a first radial distance from the first end 70 to a position indicated by the dashed line L1 shown in FIG. 6, wherein the maximum width of outlet port 40 which is open to the pocket 64 is at the line L1 and is relatively short compared to the width of the pocket 64. The area of the outlet port 40 which is open to the pocket 64 is also relatively small, being bound by the area of the outlet port located to the left of the line L1. As the leading edge 65 of the pocket 64 rotates further to a position indicated by the line L2, which is located the first radial distance from the line L1, the maximum width W of the outlet port 40 which is open to the pocket 64 remains relatively constant, increasing only slightly, such that the area of the outlet port 40 open to the pocket 64 has remained relatively small, although the area has approximately doubled substantially solely due to the rotation of the pocket 64. As the leading edge 65 of the pocket 64 rotates further to the position shown by the line L3, which is located the first radial distance from the line L2, the area of the outlet port 40 open to the pocket 64 has increased at a larger rate of change due to the combined rotation of the leading edge 65 of the pocket 64 from line L2 to L3 and the substantial increase in the maximum width W of the outlet port 40 between the edges 74 and 78 from line L2 to line L3 which is open to the pocket 64. As the leading edge 65 of the pocket 64 rotates from the first end 70 to the position shown by the line L4, which is located between the edges 74 and 76 of the outlet port 40, the area of the outlet port 40 open to the pocket 64 has increased at an even greater rate as the maximum width W of the portion of the outlet port 40 that is open to the pocket 64 has continued to increase between lines L3 and L4 to its maximum width.

The relatively small area of the outlet port 40 which is initially open to the pocket 64, as the leading edge 65 of the pocket 64 rotates from the first end 70 of the outlet port 40 to the locations of lines L1 and L2, provides a relatively low rate of flow of the high pressure fluid from the discharge chamber 46 into the pocket 64, as opposed to initially opening the pocket 64 to the maximum width W of the outlet port 40 at line L4, thereby minimizing the undesired pressure pulsations and the levels of noise and vibration that result therefrom as fluid from the discharge chamber 46 flows into the pockets 64 through the outlet port 40.

As the edges 76 and 80 of the outlet port 40 are configured in the same manner as the edges 74 and 78, the outlet port 40 operates in the same manner in connection with the pockets 66 of the rotor 52 as the leading edges 68 of the pockets 66 rotate into fluid communication with the outlet port 40 at the second end 72.

Various features of the invention had been particularly shown and described in connection with the illustrated embodiment of the invention, however, it must be understood that these particular arrangements merely illustrate, and that the invention is to be given its fullest interpretation within the terms of the appended claims.

What is claimed is:

1. A rotary positive displacement blower for producing a flow of fluid, said blower including:

a housing having a rotor chamber, an inlet port and an outlet port, said outlet port having a width dimension and a length dimension a first rotor located in said rotor chamber, said first rotor having a plurality of lobes and being rotatable about a first axis in a first direction of rotation,said first rotor forming a plurality of first pockets, each said first rotor, each said first pocket adapted to rotate into fluid communication with said inlet port to receive fluid through said inlet port and to rotate into fluid communication with said outlet port to deliver fluid through said outlet port as said first rotor rotates; and a second rotor located in said rotor chamber, said second rotor having a plurality of lobes and being rotatable about a second axis in a second direction of rotation, which is opposite to said first direction of rotation, said second rotor forming a plurality of second pockets, each said second pocket being located between adjacent lobes of said second rotor, each said second pocket adapted to rotate into fluid communication with said inlet port to receive fluid through said inlet port and to rotate into fluid communication with said outlet port to deliver fluid through said outlet port as said second rotor rotates;

said outlet port of said housing having a first end located generally adjacent said first rotor and a second end located generally adjacent said second rotor a first edge extending from adjacent said first end in a first plane which is generally perpendicular to said first and second axes of said rotors second edge extending from adjacent said second end in a second plane which is generally perpendicular to said first and second axes of said rotors and generally parallel to and spaced apart from said first plane a third edge which extends from adjacent said first end to said second edge and a fourth edge which extends from adjacent said second end to said first edge said third and fourth edges each being generally convexly curved.

whereby the area of said outlet port which becomes exposed to said pocket of said first rotor increases as said first rotor rotates.

2. The rotary positive displacement blower of claim 1 wherein said third edge of said outlet port is generally formed as a segment of an ellipse.

3. The rotary positive displacement blower of claim 1 including a first fluid passage located in said housing and extending between said outlet port and said rotor chamber, providing fluid communication between said outlet port and said rotor chamber, said first fluid passage providing a flow of fluid into each first pocket as said first rotor rotates, thereby increasing the pressure of the fluid contained in each first pocket before each said first pocket rotates into fluid communication with said outlet port.

4. The rotary positive displacement blower of claim 3 including a second fluid passage located in said housing and extending between said outlet port and said rotor chamber, said second fluid passage providing fluid communication between said outlet port and said rotor chamber, said second fluid passage providing a flow of fluid into each second pocket of said second rotor as said second rotor rotates thereby increasing the pressure of the fluid contained in each second pocket before each second pocket rotates into fluid communication with said outlet port.

5. The rotary positive displacement blower of claim 3 wherein said first fluid passage includes a backflow chamber, a backflow port providing fluid communication between said outlet port and said backflow chamber, and an injector port providing fluid communication between said backflow chamber and said rotor chamber.

6. A rotary positive displacement blower for producing a flow fluid, said blower including:

a housing having a rotor chamber, an inlet port and an outlet port a first rotor located in said rotor chamber, said first rotor having a plurality of lobes and being rotatable about a first axis in a first direction of rotation, said first rotor forming a plurality of first pockets, each said first pocket being located between adjacent lobes of said first rotor, each said first pocket adapted to rotate into fluid communication with said inlet port to receive fluid through said inlet port and to rotate into fluid communication with said outlet port to deliver fluid through said outlet port as said first rotor rotates; and a second rotor located in said rotor chamber, said second rotor having a plurality of lobes and being rotatable about a second axis in a second direction of rotation which is opposite to said first direction of rotation, said second rotor forming a plurality of second pockets, each said second pocket being located between adjacent lobes of said second rotor, each said second pocket adapted to rotate into fluid communication with said inlet port to receive fluid through said inlet port and to rotate into fluid communication with said outlet port to deliver fluid through said outlet port as said second rotor rotates;

said outlet port of said housing having a first end located generally adjacent said first rotor and a second end located generally adjacent said second rotor,a first edge extending from adjacent said first end in a first plane which is generally perpendicular to said first and second axes of said rotors, a second edge extending from adjacent said second end in a second plane which is generally perpendicular to said first and second axes of said rotors and generally parallel to and spaced apart from said first plane a third edge which extends from adjacent said first end to said second edge and a fourth edge which extends from adjacent said second end to said first edge.

said third edge including a first edge portion extending from adjacent said first end of said port towards said second edge such that the width of said port between said first edge portion and said first edge increases at a first rate of change, a second edge portion which extends from said first edge portion towards said second edge such that the width of said port between said second edge portion and said first edge increases at a second rate of change which is greater than said first rate of change and a third edge portion which extends from said second edge portion towards said second edge such that the width of said port between said third edge portion and said first edge increases at a third rate of change which is greater than said second rate of change, whereby the width of the portion of said outlet port which is in fluid communication with said pocket of said first rotor is initially relatively small, thereby providing a relatively low rate of fluid flow through said outlet port, and increases in size as said first rotor rotates.

7. The rotary positive displacement blower of claim 1 wherein said housing includes a discharge chamber and a discharge port, said outlet port providing fluid communication between said rotor chamber and said discharge chamber.

8. The rotary positive displacement blower of claim 1 including a first fluid passage located in said housing and extending between said outlet port and said rotor chamber providing fluid communication between said outlet port and said rotor chamber, said first fluid passage providing a flow of fluid into each said first pocket as said first rotor rotates thereby increasing the pressure of the fluid contained in each said first pocket before each said first pocket rotates into fluid communication with said outlet port.

9. The rotary positive displacement blower of claim 8 including a second fluid passage located in said housing and extending between said outlet port and said rotor chamber, said second fluid passage providing fluid communication between said outlet port and said rotor chamber, said second fluid passage providing a flow of fluid into each said second pocket of said second rotor as said second rotor rotates thereby increasing the pressure of the fluid contained in each said second pocket before each said second pocket rotates into fluid communication with said outlet port.

10. The rotary positive displacement blower of claim 8 wherein said first fluid passage includes a backflow chamber, a backflow port providing fluid communication between said outlet port and said backflow chamber, and an injector port providing fluid communication between said backflow chamber and said rotor chamber.

11. The rotary positive displacement blower of claim 1 wherein said third edge of said outlet port is generally convexly curved.

12. The rotary positive displacement blower of claim 11 wherein said third edge is generally formed as a segment of an ellipse.

13. The rotary positive displacement blower of claim 12 wherein said fourth edge of said outlet port is generally convexly curved.

* * * * *

UNITED STATES PATENT AND TRADEMARK OFFICE

CERTIFICATE OF CORRECTION

PATENT NO. : 5,702,240

DATED : December 30, 1997

INVENTOR(S) : Alan D. O'Neal, Michael D. Stone, and Carl R. Coles

It is certified that error appears in the above-indentified patent and that said Letters Patent is hereby corrected as shown below:

On the title page, item [54] and column 1, line 3

In the title, delete "PART" and insert --PORT-- therefor.

At column 8, line 4, insert --said first pocket being located between adjacent lobes of-- after "each"; at line 24, insert --,-- after "rotor"; at line 27, insert --, a-- after rotors; at line 31, insert --,-- after "plane"; at line 32, insert --,-- after "edge"; at line 34, insert --,-- after "edge"; and at line 35, delete "." and insert --,-- therefor.

At column 10, line 10, delete the number "1" and insert the number --6-- therefor; at line 14, delete the number "1" and insert the number --6-- therefor; at line 39, delete the number "1" and insert the number --6-- therefor.

At column 9, line 2, insert --;-- after "port"; at line 34, insert --,-- after "plane"; at line 35, insert --,-- after "edge"; and at line 47, insert --,-- after "change".

Signed and Sealed this

Seventh Day of April, 1998

Bruce Lehman

*Attest:*

BRUCE LEHMAN

*Attesting Officer*

*Commissioner of Patents and Trademarks*